US006867670B2

(12) United States Patent
McCormick et al.

(10) Patent No.: US 6,867,670 B2
(45) Date of Patent: Mar. 15, 2005

(54) CIRCUIT BREAKER WITH AUXILIARY SWITCHES AND MECHANISMS FOR OPERATING SAME

(75) Inventors: James M. McCormick, Bradenton, FL (US); Michael F. Walz, Bradenton, FL (US); Peter L. Nerstrom, Sarasota, FL (US); Thomas M. Hall, Sarasota, FL (US); Paul J. Rollmann, Brown Deer, WI (US); Edward L. Wellner, Colgate, WI (US)

(73) Assignee: Eaton Corporation, Cleveland, OH (US)

( * ) Notice: Subject to any disclaimer, the term of this patent is extended or adjusted under 35 U.S.C. 154(b) by 165 days.

(21) Appl. No.: 10/288,176

(22) Filed: Nov. 5, 2002

(65) Prior Publication Data

US 2004/0085167 A1 May 6, 2004

(51) Int. Cl.[7] ..... H01H 71/04
(52) U.S. Cl. ..... 335/6; 335/13; 335/17
(58) Field of Search ..... 335/6, 7, 13, 17, 335/18, 21, 23

(56) References Cited

U.S. PATENT DOCUMENTS

| | | | |
|---|---|---|---|
| 4,085,393 | A | 4/1978 | Grenier |
| 4,090,158 | A | 5/1978 | Oeda |
| 4,794,356 | A | 12/1988 | Yu et al. |
| 4,831,221 | A | 5/1989 | Yu et al. |
| 4,912,439 | A | 3/1990 | Nagy et al. |
| 4,939,490 | A | 7/1990 | Bernier et al. |
| 4,939,495 | A | 7/1990 | Peterson et al. |
| 5,844,493 | A | 12/1998 | Pohl et al. |
| 6,137,385 | A | 10/2000 | Conway et al. |
| 6,225,883 | B1 | 5/2001 | Wellner et al. |
| 2002/0079992 | A1 | 6/2002 | Yamagata et al. |
| 2002/0088696 | A1 | 7/2002 | Ulerich et al. |

FOREIGN PATENT DOCUMENTS

| | | |
|---|---|---|
| DE | 93 21 529 U | 2/1999 |

*Primary Examiner*—Ramon M. Barrera
(74) *Attorney, Agent, or Firm*—Marvin L. Union

(57) ABSTRACT

A subminiature circuit breaker is equipped with an arc fault auxiliary switch actuated by the arc fault trip motor through an indicator actuator that also deploys a pop-up arc fault indicator. An additional auxiliary switch actuated by the drive link on the toggle mechanism provides an indication of the open/closed state of the circuit breaker separable contacts. Both the arc fault auxiliary switch and the contact state auxiliary switch are mounted on the outside of the subminiature circuit breaker housing and are operated by an operating member and a pivoted member, respectively, extending through openings in the housing.

18 Claims, 4 Drawing Sheets

CIRCUIT BREAKER WITH AUXILIARY SWITCHES AND MECHANISMS FOR OPERATING SAME

BACKGROUND OF THE INVENTION

1. Field of the Invention

This invention relates to circuit breakers equipped with auxiliary switches to provide an indication of the type of trip, for example, an electronic trip, such as due to an arc fault, as opposed to a thermal trip, and an indication of the open/closed state of the breaker contacts.

2. Background Information

Circuit breakers used in some applications, such as aerospace, by necessity have very small physical dimensions. Traditionally, such very small circuit breakers, which are often referred to as subminiature circuit breakers, have provided only overload protection, typically through use of a bimetal coupled to a spring-loaded operating mechanism. Recently, there has been interest in providing arc fault protection in such circuit breakers. An electronic circuit detects current signatures associated with arcing. An arc fault trip signal generated by the electronic circuit energizes a trip coil that triggers the spring-loaded operating mechanism to open the contacts of the circuit breaker. An example of such a mechanism for providing arc fault protection in a subminiature circuit breaker is disclosed in U.S. Pat. No. 6,225,883.

It is often desirable in circuit breakers providing arc fault protection in addition to overload protection, to provide an indication of the type of fault that has caused the breaker to trip. Commonly owned U.S. patent application Ser. No. 09/845,943, filed on Apr. 30, 2001, provides an illuminated ring around the push/pull handle of the subminiature circuit breaker that pops up to indicate an arc fault trip. An indicator armature, provided in addition to the trip armature on the trip coil, releases a spring that causes the indicator ring to pop-up in response to an arc fault trip.

It is common to equip circuit breakers with auxiliary switches that can be used to provide remote indications of conditions within the circuit breaker. Typically, two types of auxiliary switches are provided, either singly or together. One type, that is commonly referred to as providing a bell alarm, indicates a trip by the circuit breaker. This auxiliary switch is usually actuated off of the trip latch or cradle that only changes position when the circuit breaker is tripped open and not when the circuit breaker is manually opened. The second type of common auxiliary switch is referred to just as the auxiliary switch and provides an indication of the open/closed state of the circuit breaker contacts and is often actuated off of the circuit breaker handle. The subminiature circuit breaker provides a challenge to providing auxiliary switches due to the severe space limitations.

SUMMARY OF THE INVENTION

The invention is directed to arrangements for incorporating auxiliary switches into circuit breakers, and while it has particular application to subminiature circuit breakers, aspects of the invention are applicable to other, larger circuit breakers. In accordance with one aspect of the invention, an auxiliary switch provides an indication of an electronic trip, such as an arc fault trip, when actuated through an indicator actuator that includes an indicator armature magnetically actuated by a trip motor energized by the electronic trip signal that also trips the operating mechanism to open the circuit breaker contacts. In accordance with another aspect of the invention, another auxiliary switch providing an indication of the open and closed states of the separable contacts of the breaker is actuated by a linkage coupled to the toggle mechanism in the operating mechanism that opens the separable contacts.

More particularly, the invention is directed to a circuit breaker which comprises a housing, separable contacts within the housing having open and closed states, an operating mechanism that operates the separable contacts to the open state when tripped, an electronic trip circuit that generates an electronic trip signal in response to certain conditions of current through the separable contact, a trip coil energized by the trip signal to trip the operating mechanism, and an indicator assembly that includes an electronic trip auxiliary switch and an indicator actuator actuating the electronic trip auxiliary switch in response to energization of the trip coil and including an indicating armature magnetically actuated by the trip coil. Where the electronic trip circuit is an arc fault circuit that generates an arc fault signal as the electronic trip signal, the electronic trip auxiliary switch becomes an arc fault auxiliary switch. In the case of a subminiature circuit breaker, the electronic trip auxiliary switch such as the arc fault auxiliary switch is mounted outside the housing and the indicator actuator comprises an operating member actuated by the indicator armature and extending through an opening in the housing to actuate the auxiliary switch. The spring-biased operator of the arc fault auxiliary switch can be used to bias the indicator armature, through the operating member, away from the trip coil in the absence of a trip signal.

The indicator assembly can also comprise a mechanical indicator deployed by actuation of the indicator armature in response to the arc fault signal. Such a mechanical indicator can be a pop-up indicator released by actuation of the indicator armature. In this case, the indicator armature can comprise a first arm engaging the operating member and a second arm engaging the pop-up indicator.

The indicator assembly can further comprise a contact state auxiliary switch and a linkage coupled to the operating mechanism to operate the contact state auxiliary switch to indicate the open and closed states of the separable contacts. More particularly, the operating mechanism can have a handle and a toggle mechanism including a drive link connected to the handle. In this arrangement, the linkage includes a pivoted member engaged by the drive link to operate the contact state auxiliary switch. Again, in the case of the subminiature circuit breaker, both the arc fault auxiliary switch and the contact state auxiliary switch can be mounted outside the housing with the operating member extending through a first opening in the housing to actuate the arc fault auxiliary switch and the pivoted member extending through a second opening in the housing to operate the contact state auxiliary switch.

In accordance with another aspect of the invention, a circuit breaker comprises a housing, separable contacts mounted in the housing and having an open state and a closed state, an operating mechanism comprising a handle and a toggle mechanism coupled to the handle for operating the separable contacts between the open and closed states, and an indicator assembly comprising a contact state auxiliary switch, and a linkage coupled to the toggle mechanism to operate the contact state auxiliary switch to indicate the open and closed states of the circuit breaker. The toggle mechanism can comprise a drive link connected to the handle and having an abutment surface that can be provided by an offset in the drive link. The linkage can include a pivoted member and a spring biasing the pivoted member against the abutment surface on the drive link and having a finger engaging an operator on the contact state auxiliary switch. Where the circuit breaker is a subminiature breaker, the contact state auxiliary switch is mounted outside the housing and a finger on the pivoted member extends through an opening in the housing to engage the operator of the contact state auxiliary switch.

The invention also embraces an indicator assembly for a circuit breaker comprising a trip motor that when energized initiates opening of separable contacts. The assembly comprises, an auxiliary switch, and an indicator actuator actuating the auxiliary switch in response to energization of the trip motor and comprises an indicator armature magnetically actuated by the trip motor. Where the circuit breaker is a subminiature circuit breaker, the auxiliary switch is mounted outside the housing and the indicator actuator comprises an operating member actuated by the indicator armature and extending through an opening in the housing to actuate the auxiliary switch. The auxiliary switch can comprise a spring-biased operator that biases the indicator armature through the operating member away from the trip motor when the trip motor is not energized.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
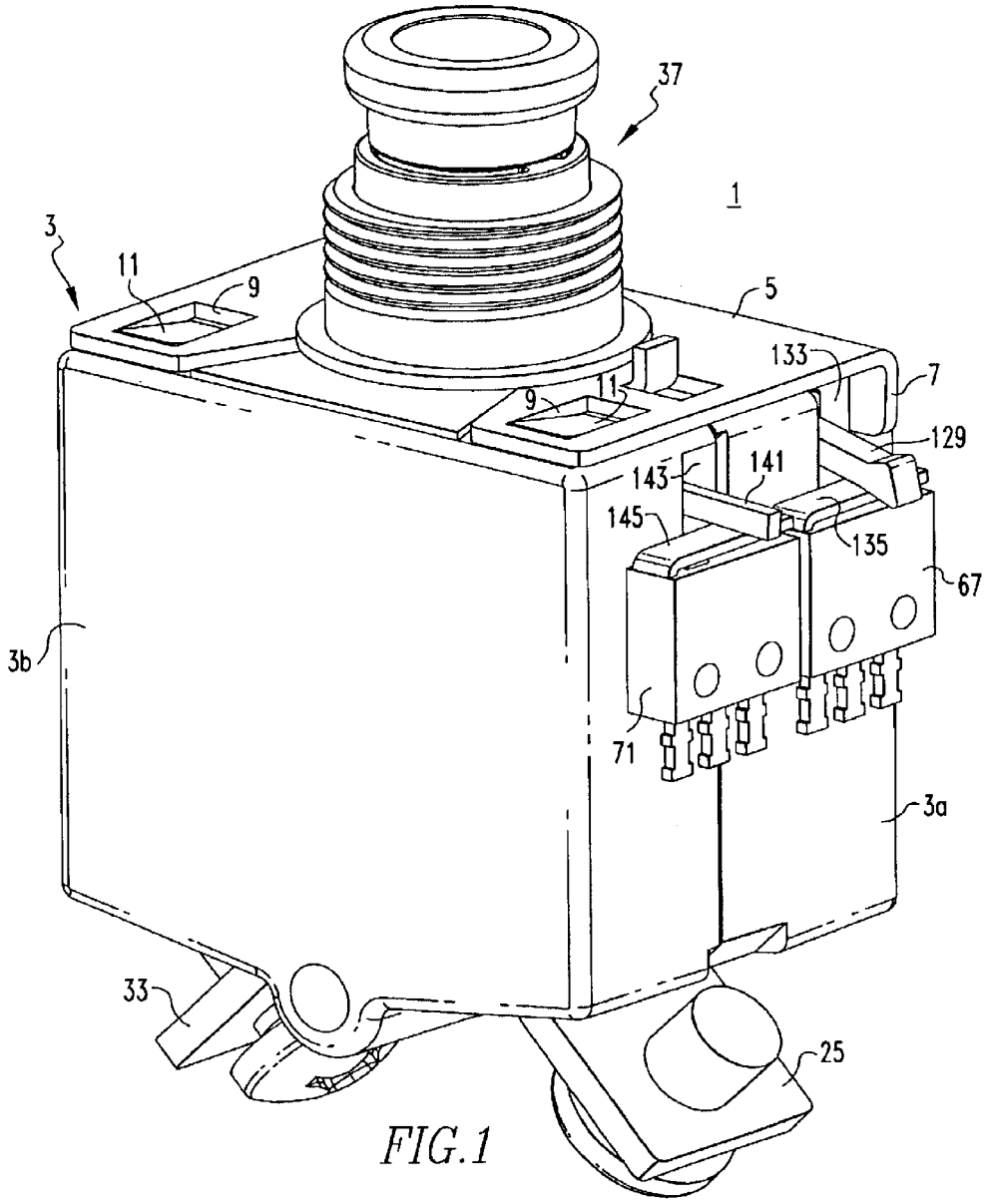
FIG. 1 is an isometric view of an assembled circuit breaker in accordance with the invention.
Figure 2:
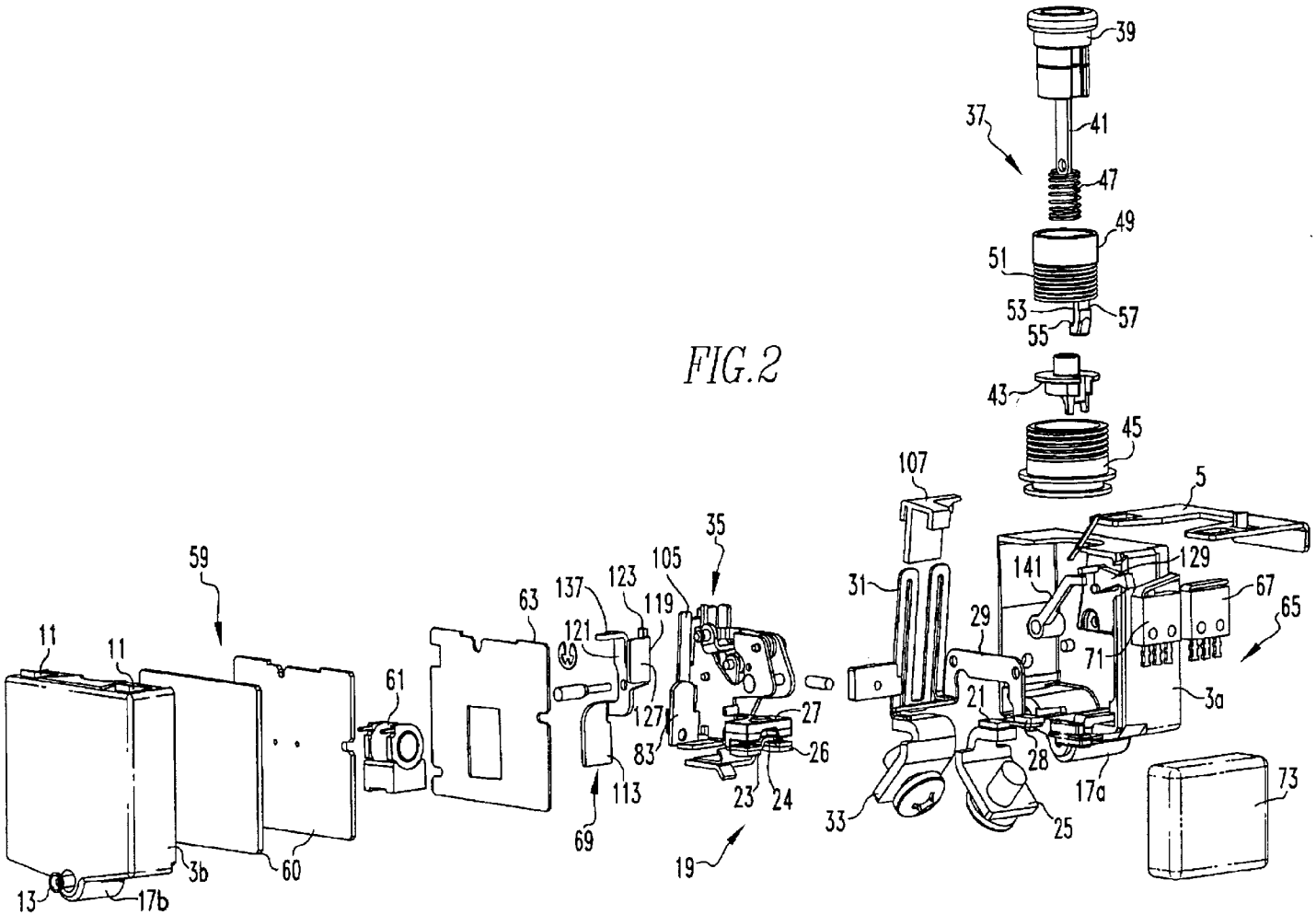
FIG. 2 is an exploded isometric view of the circuit breaker of FIG. 1.

The invention will be described as applied to a subminiature circuit breaker; however, it will evident that aspects of the invention have application to other, larger circuit breakers. Turning to FIGS. 1 and 2, the circuit breaker 1 has a housing 3 composed of two molded parts 3*a* and 3*b* which are held together at the upper end by a metal clip 5 having a lip 7 which engages the half 3*a* of the housing, and a pair of openings 9 which slide over and engage beveled projections 11 on the second half of the housing 3*b*. The bottom halves of the housing are secured together by a rivet 13 extending through counterbored holes 15 in bosses 17*a* and 17*b* integrally molded on the bottom of the housing sections 3*a* and 3*b*. The circuit breaker 1 includes separable contacts 19 formed in the exemplary breaker by a fixed contact 21 and movable contact 23. The fixed contact 21 is connected to a line terminal 25. The movable contact 23 is attached to a contact bridge 24 mounted on a pivoted contact arm 27. See also FIGS. 3 and 4. When the separable contacts 19 are closed, a second moveable contact 26 on the contact bridge 24 closes on a second fixed contact 28 on a bus bar 29 which, in turn, is connected to a main bimetal 31. The extended length bimetal is folded to form a central U or M section with the opposite end connected to a load terminal 33.

The contact arm is pivoted between open and closed states of the separable contacts 19 by an operating mechanism shown generally at 35. This operating mechanism 35 may be operated manually to open and close the separable contacts by a handle assembly 37. Details of the construction and operation of the operating mechanism 35 are not necessary to an understanding of the invention, however, such mechanisms are well-known in the art and a similar mechanism is described in previously mentioned co-pending U.S. patent application Ser. No. 09/845,943. The handle assembly 37 (shown exploded in FIG. 2) includes the handle 39 with a stem 41 which extends through a guide 43 seated in a bezel 45 captured between the sections 3*a* and 3*b* of the housing. A helical compression spring 47 biases the handle upward to an open or off position. A mechanical arc fault indicator in the form of pop-up ring 49 is concentrically mounted on the handle stem 41 and is biased upward by a second helical compression spring 51. The arc fault ring 49 also has a stem 53 with a shoulder 55 that engages the guide to limit upward travel of the arc fault ring 49, and a latch edge 57, which as will be described is engaged to latch the arc fault ring 49 down inside the bezel 45 and which is released to allow the arc fault ring 49 to pop up when an arc fault has been detected.

Arc faults are detected by an electronic circuit 59 (distributed on a pair of circuit boards 60) that generates an electrical trip signal to energize a trip motor 61. A barrier 63 isolates the electronic circuit 59 from the operating mechanism 35. The trip motor 61, which is an electromagnet, trips the operating mechanism 35 in response to detection of an arc fault in a manner to be described.

Figure 3:
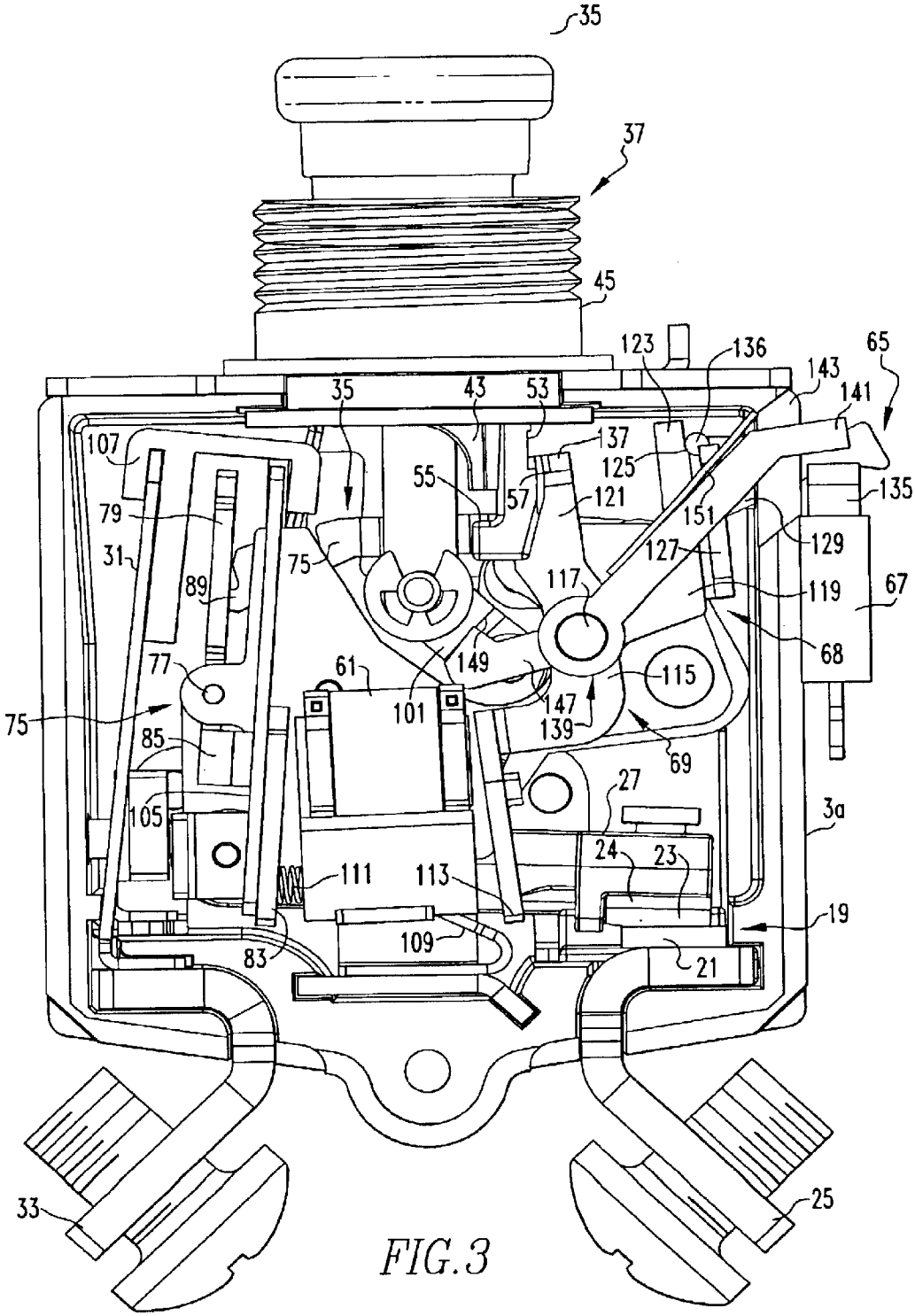
FIG. 3 is an elevation view with half the housing removed showing the circuit breaker in the closed state.
Figure 4:
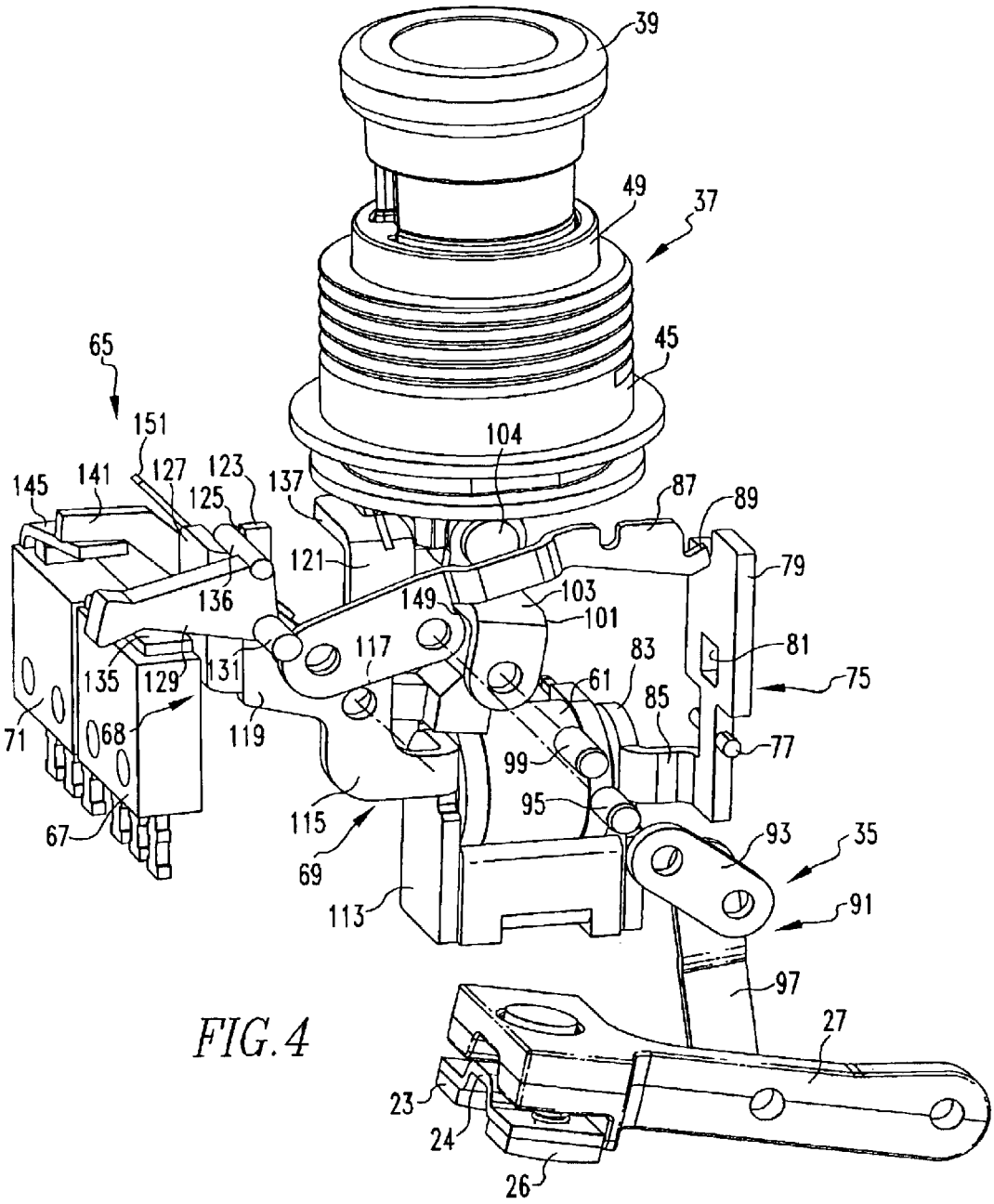
FIG. 4 is an isometric view with nonessential parts removed shown from the opposite side from FIG. 3 and in the tripped state with the trip coil energized.

The circuit breaker 1 incorporates an indicator assembly 65 that includes an electronic trip or arc fault auxiliary switch 67. It also includes an indicator armature 69 that is magnetically actuated by the trip motor 61. The indicator assembly 65 can also include a contact state auxiliary switch 71 that is actuated in a manner to be described. Because of the very limited space in a subminiature circuit breaker, for instance, the housing 3 can have outer dimensions that do not exceed 2.54 cm (one inch). Accordingly, the arc fault auxiliary switch 67 and the contact state auxiliary switch 71 are mounted on the outside of the housing 3 and are actuated in a manner to be described. If desired, these external auxiliary switches can be protected by a cover 73. Turning particularly to FIGS. 3 and 4, the operating mechanism 35 includes a trip latch 75 pivoted around a lateral pivot axis 77. This trip latch 75 includes a latch plate 79 with a latch opening 81 and a trip armature 83 offset from the latch plate 79 for alignment with one end of the trip motor 61 by bracket 85.

The operating mechanism 35 also includes a latch lever 87 pivoted at one end and having a latch lip 89 at the other end which can be latched in the latch opening 81 of the latch plate 79, although it is shown in the unlatched or tripped position in FIG. 4. The operating mechanism 35 further includes a toggle mechanism 91 that includes an upper toggle link 93 pivotally connected to the latch lever 87 by a pin 95. The toggle mechanism 91 also includes a lower toggle link 97 which is pinned at one end to the lower end of the upper toggle link 93 by a knee pin 99. As is well known, the lower toggle link is pinned to the contact arm 27. The details of such a toggle mechanism are also described in co-pending application Ser. No. 09/845,943. The toggle mechanism 91 further includes a drive link 101 engaging a knee pin at a lower end. This drive link 101 has an offset section 103 so that the upper end is aligned for connection by a pin 104 to the lower end of the handle stem 41.

When the handle 39 is pushed down from the open position shown in FIG. 4 to the closed position shown in FIG. 3, the toggle mechanism is erected to rotate the contact arm 27 to close the separable contacts 19 as shown in FIG. 4. This rotates the latch lever 87 until the latch lip 89 engages the latch opening 81 and the latch plate 79 to hold the separable contacts closed. (See FIG. 3) With the separable contacts 19 closed, current flows from the line terminal 25 through the separable contacts 19, contact bridge 24, contacts 26 and 28, bus bar 29, the bimetal 31, and the load terminal 33. As shown in FIG. 3, an ambient bimetal 105 is secured to the trip armature 83. The free end of this ambient bimetal 105 is coupled to the free end of the main bimetal 31 by an electrically insulative clip 107. A persistent overload condition causes the main bimetal 31 to heat up and bend counterclockwise as viewed in FIG. 3. This rotation is transmitted through the ambient bimetal 105 to rotate the trip latch 75 counterclockwise so that the trip lever 87 is unlatched allowing the toggle mechanism 91 to collapse. With the contact arm 27 thus unrestrained, a leaf spring 109 rotates the contact arm 27 counterclockwise to open the separable contacts 19. The ambient bimetal 105 provides temperature compensation for this thermal trip.

When the electronic circuit 59 detects a current signature associated with an arc fault, the trip motor 61 is energized to magnetically attract the trip armature 83 which also leads to unlatching of the latch lever 87 and opening of the separable contacts in the manner described above. The trip latch 75 is biased to the latched position by a helical compression spring 111.

As mentioned, the indicator assembly 65 provides both an indication of an arc fault trip and the state of the separable contacts 19. By reference to FIGS. 2, 3 and 4, it can be seen at the indicator armature 69 which forms part of the indicator assembly 65 has a planar section 113 adjacent the opposite end of the trip motor 61 from the trip armature 83. An integral support section 115 extends perpendicular to the planar section 113 and mounts the indicator armature 69 for rotation about a pivot axis 117. The support section 115 extends beyond the pivot and is bifurcated into a first arm 119 and a second arm 121. The first arm 119 has an extension 123 on a free end forming a notch 125. This first arm 119 further has a flange 127 extending generally parallel to the planar section 113 to provide balance for the indicator armature 69.

The indicator actuator 68 further includes an operating member 129 mounted for rotation on an integral pin 131 about an axis generally parallel to the pivot axis 117. The operating member 129 extends through a first opening 133 (see FIG. 1) in the housing 3 to engage the operator in the form of actuating lever 135 on the arc fault auxiliary switch 67 mounted on the outside of the housing 3. A coupling pin 136 on the operating member 129 engages the notch 125 on the first arm 119 of the indicator armature 69.

In the event of an arc fault, energization of the trip motor 61 results in clockwise rotation of the indicator armature 69 about the pivot axis 117 as viewed in FIG. 3 through magnetic attraction of the planar section 113. This results in counterclockwise rotation of the operating member 129 as viewed in FIG. 4 to depress the operating lever 135 on the arc fault auxiliary switch 67. As this simultaneously occurs with the tripping of the operating mechanism through rotation of the trip latch 75 by the arc fault signal, the arc fault auxiliary switch 67 provides an indication that an arc fault trip has occurred.

The indicator armature 69 is biased counterclockwise to the unactuated position shown in FIG. 3 by a spring. In the exemplary embodiment of the invention, the biasing force is provided by an internal spring (not shown) acting on the actuating lever 135 of the arc fault auxiliary switch 67. This bias force is overridden by the magnetic force generated by the trip motor 61 when energized by the trip signal.

The second arm 121 of the indicator armature 69 has an integral tab 137 extending transversely to its free end. This tab 137 engages the latch edge 57 on the stem 53 of the arc fault ring 49 to latch the arc fault ring in the undeployed position inside the bezel 45 as shown in FIG. 3. When the trip motor 61 is energized in response to an arc fault signal and the indicator armature 69 is rotated clockwise as shown in FIG. 3, the tab 137 is released from the latch edge 57 so that the spring 51 pops the arc fault ring 49 up to the deployed position shown in FIG. 4 where it is visible to an observer. In the event of a thermal trip where the bimetal 31 bends to release the latch lever 87, the toggle is collapsed and the handle is raised but the arc fault ring 49 remains latched in the undeployed position. Thus, the handle is raised to signal a trip and the absence of a raised arc fault indicator ring 49 indicates a thermal trip rather than an arc fault trip.

The indicator assembly 65 also includes a linkage in the form of a pivoted member 139, which in the exemplary embodiment is pivoted about the same pivot axis 117 as the indicator armature 69. This pivoted member 139 has a finger 141 which extends through a second opening 143 in the housing 3 to engage an operator in the form of actuating lever 145 on the contact state auxiliary switch 71 mounted on the outside of the housing 3. The pivoted member 139 further has a projection 147 which bears against an abutment surface 149 formed by the offset 103 in the drive link 101 of the toggle mechanism 91. With the separable contacts 19 closed, the handle 39 is in the lowered position shown in FIG. 3 where the abutment surface 149 engages the projection 147 to rotate the pivoted member 139 counterclockwise in FIG. 3 out of engagement with the operating member 145 on the contact state auxiliary switch 71. Normally closed contacts within the contact state auxiliary switch can be used to indicate that the separable contacts 19 of the circuit breaker are closed. Alternatively, normally open contacts of the contact state auxiliary switch 71 can be used to provide the inverse indication of separable contact closure. When the circuit breaker is opened manually by raising the handle 39 or automatically by tripping of the operating mechanism 35, either by a thermal trip or an arc fault trip, the toggle mechanism 91 collapses and the drive link 101 is rotated to the raised position shown in FIG. 4. This allows a leaf spring 151 which bears against the housing 3 to rotate the pivoted member 139 clockwise as shown in FIG. 3 to depress the operator 145 on the contact state auxiliary switch 71 as shown in FIG. 4 to provide an indication that the separable contacts 19 of the circuit breaker are open. The leaf spring 151 is strong enough to overcome the bias of the actuating lever 145 on the contact state auxiliary switch 71.

Thus, in accordance with the invention the very small subminiature circuit breakers as well as other circuit breakers can be easily equipped with auxiliary switches that provide an indication of an arc fault trip and the open/closed state of the circuit breaker.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a housing;

separable contacts mounted in the housing and having an open state and a closed state;

an operating mechanism mounted in the housing operating the separable contacts to the open state when tripped;

an electronic trip circuit generating an electronic trip signal in response to certain conditions of current through the separable contacts;

a trip motor energized by the trip signal to trip the operating mechanism; and an indicator assembly comprising:

an electronic trip auxiliary switch; and an indicator actuator actuating the electronic trip auxiliary switch in response to energization of the trip motor and comprising an indicator armature magnetically actuated by the trip motor.

2. The circuit breaker of claim 1 which is a subminiature circuit breaker and wherein the electronic trip auxiliary switch is mounted outside the housing and the indicator actuator comprises an operating member actuated by the indicator armature and extending through an opening in the housing to actuate the electronic trip auxiliary switch.

3. The circuit breaker of claim 1, wherein the electronic trip circuit is an arc fault circuit that generates an arc fault signal as the electronic trip signal, and the electronic trip auxiliary switch is an arc fault auxiliary switch that is actuated by the trip motor in response to the arc fault signal.

4. The circuit breaker of claim 3, wherein the circuit breaker is a subminiature circuit breaker and the electronic trip auxiliary switch is mounted outside the housing, the indicator actuator comprising an operating member actuated by the indicator armature and extending through an opening in the housing to actuate the electronic trip auxiliary switch.

5. The circuit breaker of claim 4, wherein the electronic trip auxiliary switch has a spring-biased operator that biases the indicator armature through the operating member away from the trip motor in the absence of an electronic trip signal.

6. The circuit breaker of claim 4, wherein the indicator assembly comprises a mechanical indicator deployed by actuation of the indicator armature in response to the electronic trip signal.

7. The circuit breaker of claim 6, wherein the mechanical indicator comprises a pop-up indicator released by actuation of the indicator armature.

8. The circuit breaker of claim 7, wherein the indicator armature comprises a first arm engaging the operating member and a second arm engaging the pop-up indicator.

9. The circuit breaker of claim 6, wherein the indicator assembly further comprises a contact state auxiliary switch and a linkage coupled to the operating mechanism to operate the contact state auxiliary switch to indicate the open state and the closed state of the separable contacts.

10. The circuit breaker of claim 9, wherein the operating mechanism comprises a handle and a toggle mechanism connected to the handle for manual operation of the separable contacts between the open state and the closed state and the linkage comprises a pivoted member engaged by the toggle mechanism to operate the contact state auxiliary switch.

11. The circuit breaker of claim 10, wherein both the electronic trip auxiliary switch and the contact state auxiliary switch are mounted outside the housing, the operating member extends through a first opening in the housing to actuate the electronic trip auxiliary switch and the pivoted member extends through a second opening in the housing to operate the contact state auxiliary switch.

12. The circuit breaker of claim 11, wherein the indicator assembly further comprises a spring biasing the contact state auxiliary switch to a closed state when the separable contacts are opened.

13. A circuit breaker comprising:

a housing;

separable contacts mounted in the housing and having an open state and a closed state;

an operating mechanism comprising a handle and a toggle mechanism coupled to the handle for operating the separable contacts between the open and closed states;

an indicator assembly comprising:

a contact state auxiliary switch; and a linkage coupled to the toggle mechanism to operate the contact state auxiliary switch to indicate the open and closed states of the separable contacts, wherein the contact state auxiliary switch comprises an operating member, and the toggle mechanism comprises a drive link connected to the handle, the drive link having an abutment surface, the linkage comprising a pivoted member and a spring biasing the pivoted member against the abutment surface on the drive link and the pivoted member having a finger engaging the operating member on the contact state auxiliary switch.

14. The circuit breaker of claim 13, wherein the abutment surface on the drive link is formed by a lateral offset on the drive link.

15. The circuit breaker of claim 13, wherein the circuit breaker is a subminiature circuit breaker, the contact state auxiliary switch is mounted outside the housing, and the pivoted member has a finger extending through an opening in the housing to engage the operator on the contact state auxiliary switch.

16. An indicator assembly for a circuit breaker comprising a trip motor that when energized initiates opening of separable contacts, the indicator assembly comprising:

an auxiliary switch; and an indicator actuator actuating the auxiliary switch in response to energization of the trip motor and comprising an indicator armature magnetically actuated by the trip motor.

17. The indicator assembly of claim 16 for a circuit breaker that is a subminiature circuit breaker comprising a housing containing separable contacts and the trip motor, and wherein the auxiliary switch is mounted outside the housing and the indicator actuator includes an operating member actuated by the indicator armature and extending through an opening in the housing to actuate the auxiliary switch.

18. The indicator assembly of claim 17, wherein the auxiliary switch comprises a spring-biased operator that biases the indicator armature through the operating member away from the trip motor when the trip motor is not energized.

* * * * *